US007563051B2

(12) United States Patent
Buckley et al.

(10) Patent No.: US 7,563,051 B2
(45) Date of Patent: Jul. 21, 2009

(54) VEHICLE BARRIER SYSTEM

(75) Inventors: Nigel Buckley, Ashburton (AU); Paul Morris Deed, Keysborough (AU); Zeljko Macher, Mooroolbark (AU)

(73) Assignee: Tallwang Holdings Pty. Ltd. (AU)

( * ) Notice: Subject to any disclaimer, the term of this patent is extended or adjusted under 35 U.S.C. 154(b) by 0 days.

(21) Appl. No.: 10/596,228

(22) PCT Filed: Nov. 8, 2004

(86) PCT No.: PCT/AU2004/001544

§ 371 (c)(1),
(2), (4) Date: Jun. 5, 2006

(87) PCT Pub. No.: WO2005/045135

PCT Pub. Date: May 19, 2005

(65) Prior Publication Data

US 2006/0233607 A1 Oct. 19, 2006

(30) Foreign Application Priority Data

Nov. 6, 2003 (AU) ..... 2003906127

(51) Int. Cl.
*E01F 13/12* (2006.01)
*E01F 15/06* (2006.01)

(52) U.S. Cl. ..... 404/6; 404/9; 404/10; 49/49; 256/13.1

(58) Field of Classification Search ..... 404/6, 404/10, 9; 256/13.1; 49/49, 34; 188/376
See application file for complete search history.

(56) References Cited

U.S. PATENT DOCUMENTS 1,692,142 A * 11/1928 Strauss ..... 49/9
4,759,606 A * 7/1988 McDowell ..... 359/553
4,823,923 A * 4/1989 Moyer ..... 188/376
4,824,282 A * 4/1989 Waldecker ..... 404/6
4,828,424 A 5/1989 Crisp, Sr.
4,893,119 A * 1/1990 Nasatka ..... 340/928
4,926,592 A * 5/1990 Nehls ..... 52/98
4,989,835 A * 2/1991 Hirsh ..... 256/13.1
5,009,542 A * 4/1991 Hardin et al. ..... 404/6
5,181,794 A * 1/1993 Wilson et al. ..... 404/6
5,547,310 A * 8/1996 Muller ..... 404/6
5,592,717 A * 1/1997 Longo ..... 16/367
6,062,765 A * 5/2000 Dotson ..... 404/6
6,119,399 A * 9/2000 McCain et al. ..... 49/340
6,179,517 B1 * 1/2001 Nelson ..... 404/6
6,382,869 B1 * 5/2002 Dickinson ..... 404/6
6,488,268 B1 * 12/2002 Albritton ..... 256/13.1
6,619,630 B2 * 9/2003 Albritton ..... 256/13.1
6,793,204 B2 * 9/2004 Albritton ..... 256/13.1
6,843,613 B2 * 1/2005 Gelfand et al. ..... 404/6
6,926,462 B1 * 8/2005 Fuganti et al. ..... 404/6

(Continued)

*Primary Examiner*—Raymond W Addie
(74) *Attorney, Agent, or Firm*—Carstens & Cahoon LLP

(57) ABSTRACT

The invention discloses a vehicle barrier system (10) including a barrier (46) movable between an open position to allow vehicle access therethrough and a closed position which prevents vehicle access therethrough. Barrier (46) is attached to barrier supports (48, 50) at either end of barrier (46) with barrier supports (48, 50) being secured to a ground engaging slide plate (52). The ground engaging slide plate (52) will slide after a predetermined force is applied thereto by vehicle (102) impact with barrier (46) to absorb the impact energy of vehicle (102).

12 Claims, 19 Drawing Sheets

U.S. PATENT DOCUMENTS 7,014,388 B2 * 3/2006 Bibber ..... 404/6
2003/0099511 A1 * 5/2003 Lund ..... 404/6
2003/0210954 A1 * 11/2003 Kang ..... 404/6

* cited by examiner 116
142
150
152
146
52
130
80
60
64
68
56
134
138
136
132

VEHICLE BARRIER SYSTEM

FIELD OF THE INVENTION

This invention relates to a vehicle barrier system and relates particularly, though not exclusively, to a vehicle barrier system to prevent intrusion through a barrier by an unauthorised vehicle.

BACKGROUND OF THE INVENTION

Threats from car bombs have become prevalent amongst terrorists throughout the world. Terrorists will ram a gate of an embassy or other selected building with a vehicle. Once entry is gained they detonate their bomb as close to the building as possible to maximise the death and injuries caused by their actions. Gates and doors are necessary to gain access to the building or perimeter fence and provide a weak link for such terrorist attacks. Most gates rely on the weight of the gate and its mounting to a foundation to decelerate such vehicles. These gates do not attempt to absorb the shock and the vehicle may still penetrate a significant distance. The resulting damage is usually significant and will require costly and timely replacement.

SUMMARY OF INVENTION

It is an object of the present invention to provide a vehicle barrier system that will absorb the impact energy from the moving vehicle and reduce the penetration distance when the vehicle has been stopped.

A further object of the invention is to provide a vehicle barrier system that can be readily repaired or replaced once vehicle impact has occurred.

In one aspect of the present invention there is provided a vehicle barrier system including a barrier movable between an open position to allow vehicle access therethrough and a closed position which prevents vehicle access therethrough, said barrier being attached to barrier supports at either end of said barrier, said barrier supports being secured to a slide plate which will slide after a predetermined force is applied thereto by vehicle impact with said barrier to absorb the impact energy of said vehicle.

Preferably said slide plate is sufficiently long to have a part of said vehicle sitting thereon at impact. Preferably said movement of said slide plate is controllable. Preferably said movement is controllable by one or more of a group selected from a ballast attached directly or indirectly to said slide plate, at least one further slide plate attached to said slide plate, the extension of attachment means attached to said at least one further slide plate and/or said ballast, the extension of attachment means attached to said slide plate and a surface over which said slide plate moves, and the shearing of at least one rivet securing said slide plate to a surface on which said slide plate slides.

In a practical embodiment a plurality of rivets protrudes through said at least one slot in said slide plate. Preferably a pair of slots are provided and said slide plate rests on a sliding surface formed by a pair of ground engaging beams aligned with respective slots. Preferably a pair of upright beams are secured to the ground in front of respective barrier supports, said upright beams being secured to said pair of ground engaging beams at one end and pivotally and/or slidably linked to said barrier supports at the other end.

In a further aspect of the invention there is provided a vehicle barrier system including a barrier movable between an open position to allow vehicle access therethrough and a closed position which prevents vehicle access therethrough, said barrier being attached to barrier supports at either end of said barrier, said barrier supports being secured to the ground on a ground engaging plate(s), a pair of bridging slide plates on one side of each of said barrier supports attached at one end to a respective said barrier support and at the other end to said ground engaging plate(s), said slide plates joined by at least one rivet, said slide plates movable with respect to one another when said at least one rivet is sheared after a predetermined force is applied from vehicular impact with said barrier to absorb the impact energy of said vehicle.

BRIEF DESCRIPTION OF THE DRAWINGS

In order that the invention may be more readily understood and put into practical effect, reference will now be made to the accompanying drawings, in which.

DETAILED DESCRIPTION OF THE PREFERRED EMBODIMENTS

Figure 1:
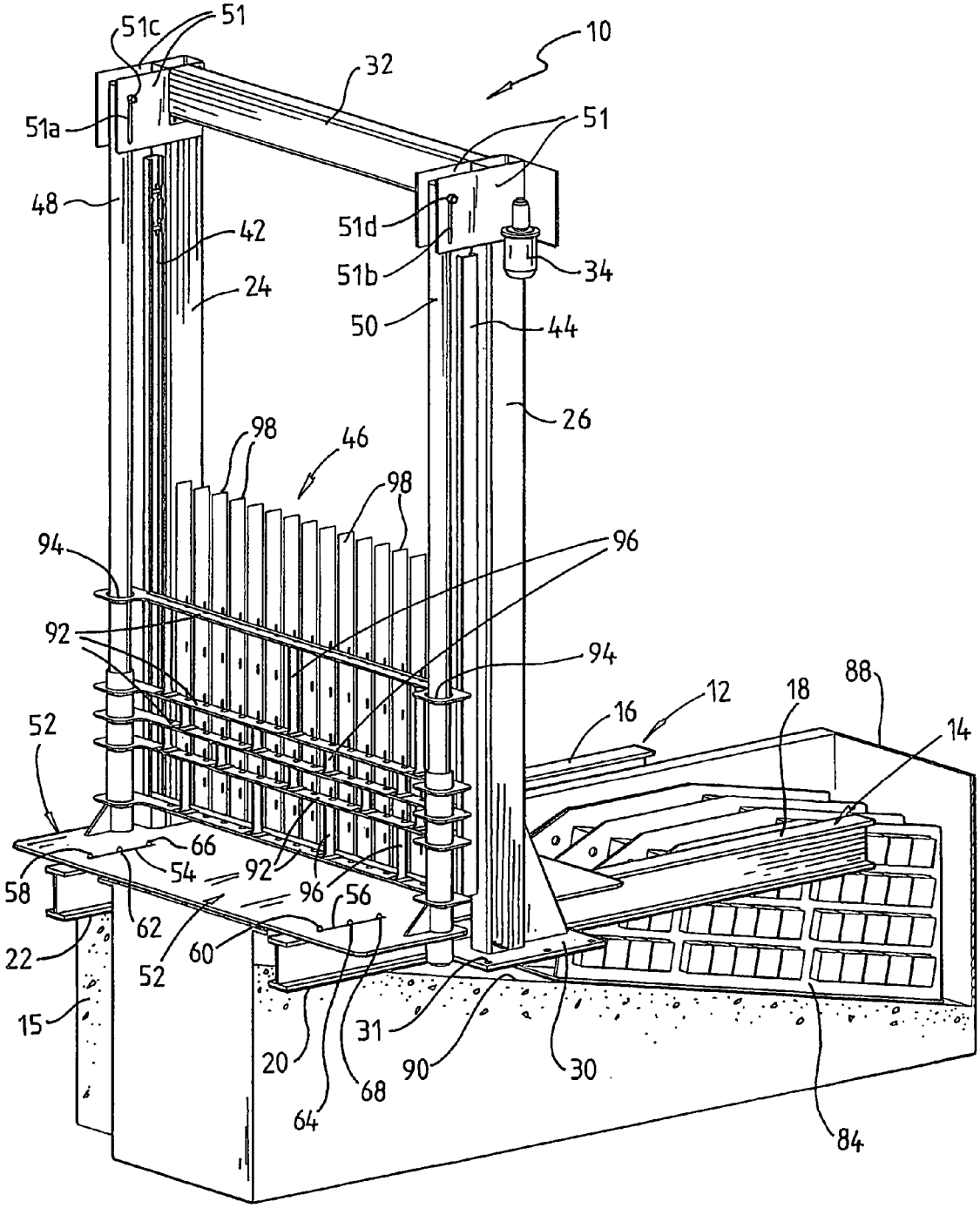
FIG. 1 is a perspective view of a first embodiment of a vehicle barrier system made in accordance with the invention showing the barrier in the closed position.
Figure 2:
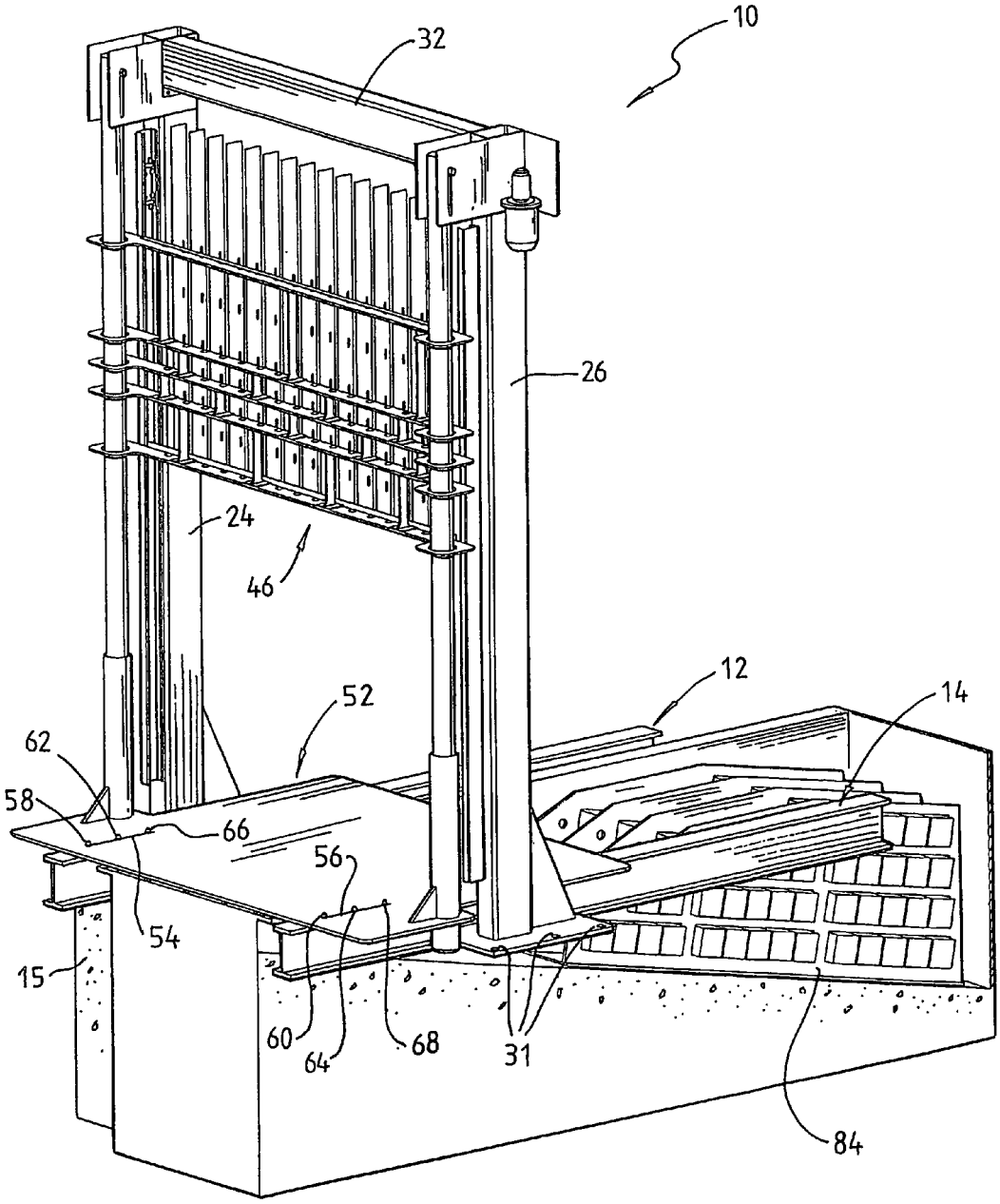
FIG. 2 is the same view as FIG. 1 in the open position.
Figure 3:
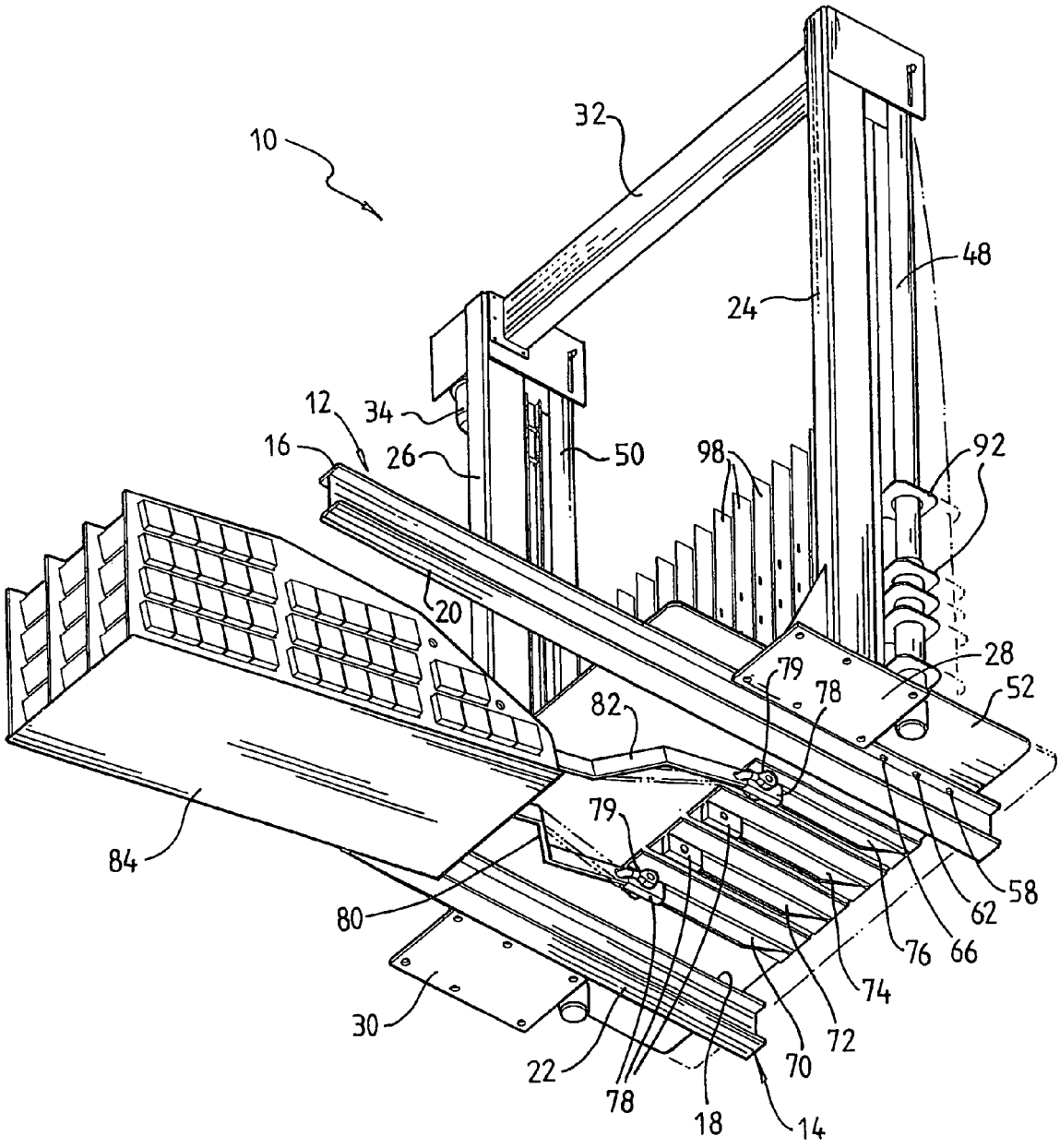
FIG. 3 is an underneath view of FIG. 1.
Figure 4:
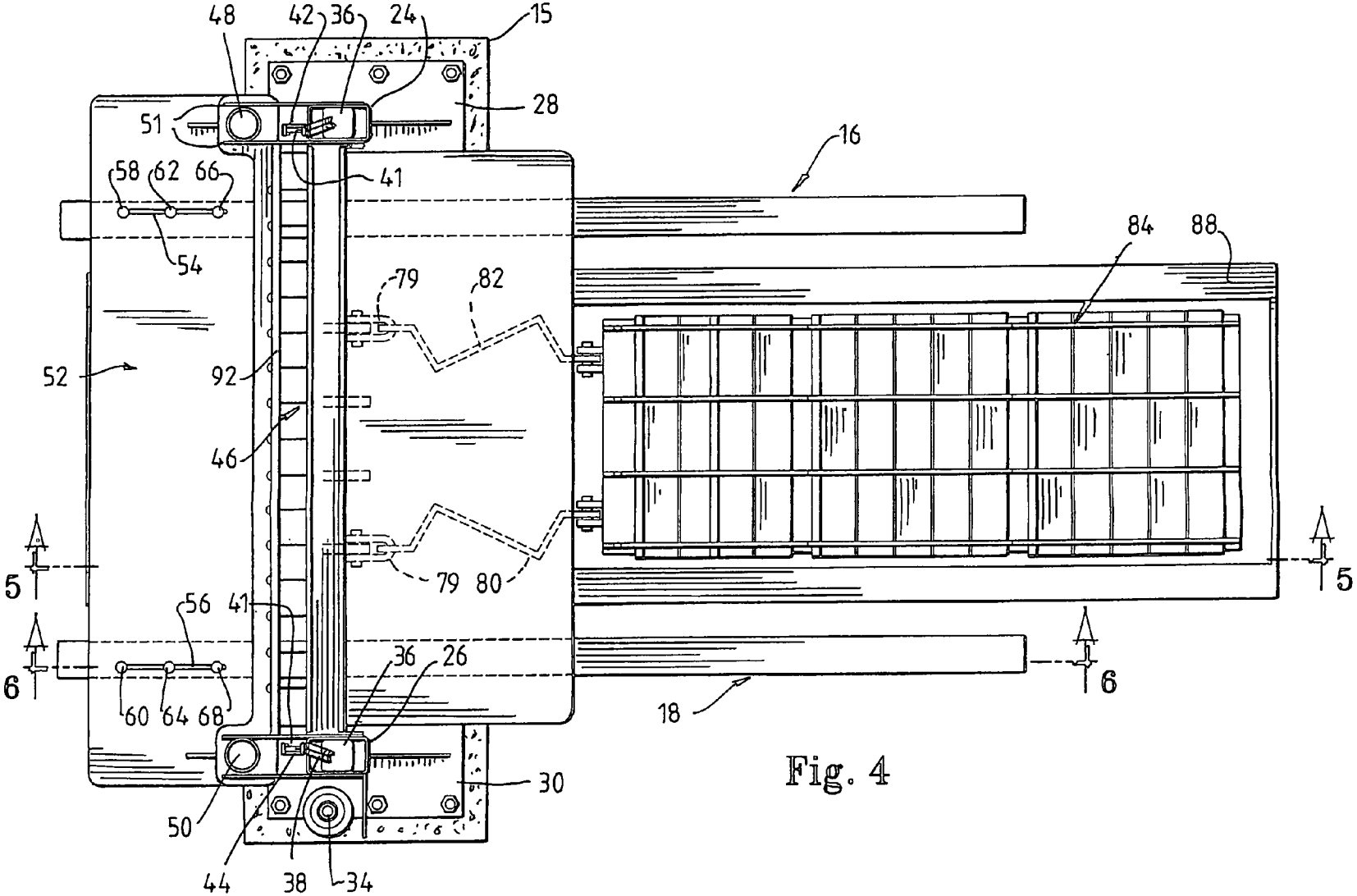
FIG. 4 is a plan view of FIG. 1.
Figure 5:
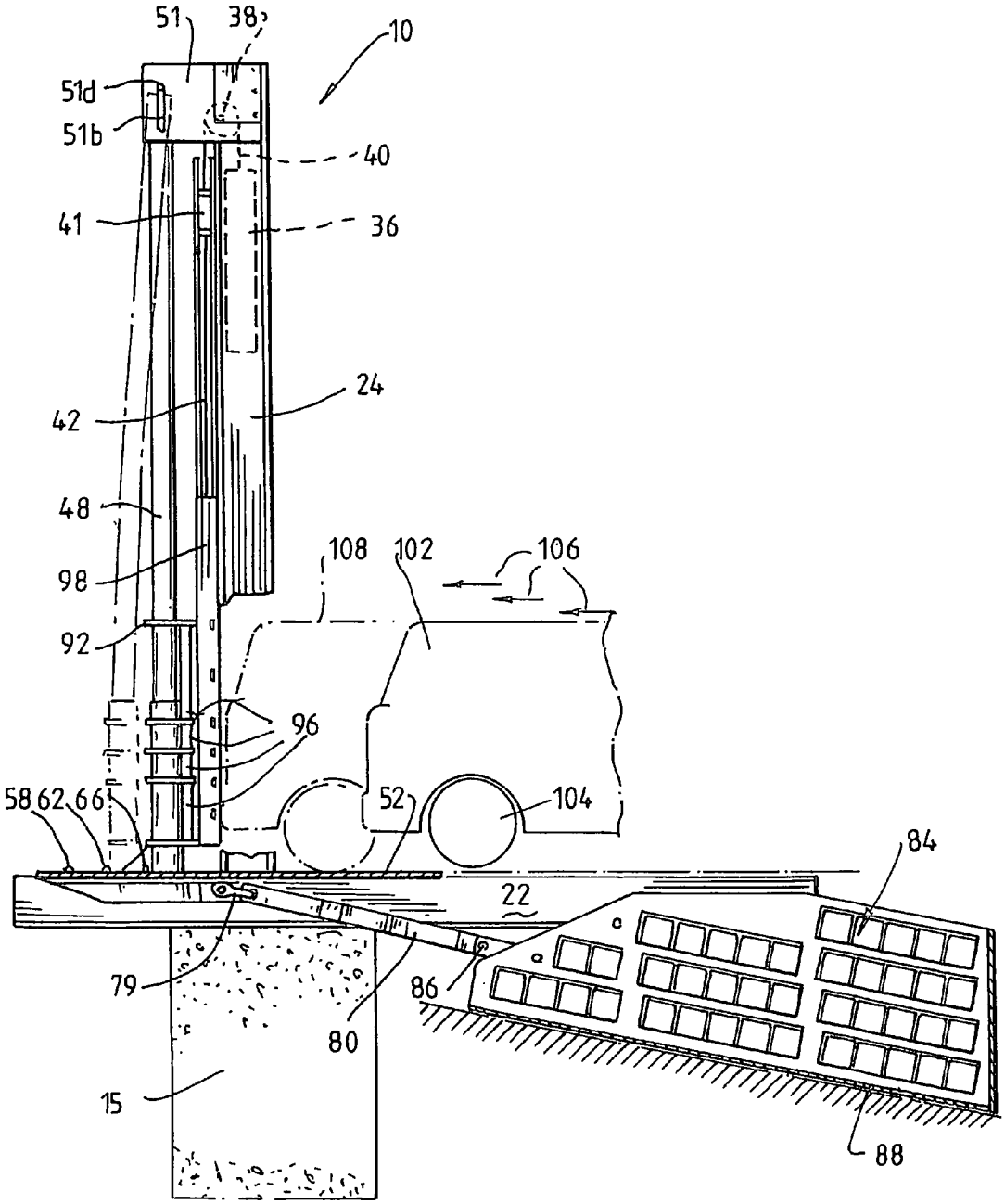
FIG. 5 is a cross-sectional view along and in the direction of arrows 5-5 shown in FIG. 4.

Throughout this specification the same reference numerals have been used to identify similar integers in the various embodiments to reduce repetition of description. In FIGS. 1 to 5 there is shown a vehicle barrier system 10 which will protect an opening (not shown) in a perimeter fence or building opening. The vehicle barrier system 10 includes a pair of I-beams 12,14 mounted parallel with each other. Although I-beams have been described it is clear from embodiments to be discussed later that the I-beams could be replaced by an anchor plate on the ground. I-beams 12,14 are typically secured to the ground by concrete supports 15. I-beams 12,14 have respective top flanges 16,18 and lower flanges 20,22. A pair of hollow beams 24,26 are welded to respective support plates 28,30. Apertures 31 in support plates 28, 30 allow support plates 28,30 to be bolted to concrete supports 15. A cross- beam 32 bridges hollow beams 24,26. An electric motor 34 is secured to beam 26 and allows barrier 46 to be raised or lowered.

Counterweights 36 balance the weight of barrier 46 and are located within hollow beams 24,26.

Pulleys 38 guide a cable 40 on either side of barrier 46 with motor 34 providing movement of cables 40. Barrier guides 42,44 are secured to the sides of hollow beams 24,26 and allow sliders 41 coupled to barrier 46 to slide up and down.

A pair of barrier supports 48,50 are mounted parallel to hollow beams 24,26. The top of barrier supports 48,50 are pivotally and slidably linked to beam plates 51 on either side of hollow beams 24,26. Pins 51*c*, 51*d* project through slots respectively to allow movement of barrier supports 48, 50. At the other end of barrier supports 48,50 there is attached a slide plate 52.

Slide plate 52 rests on the top flanges 16,18 of I-beams 12,14. Slots 54,56 are provided in slide plate 52 and three pairs of rivets 58,60; 62, 64; 66,68 are secured to the top flanges 16,18 of I-beams 12,14. Attachment beams 70,72, 74,76 are welded to the underside of slide plate 52. The attachment beams 70 - 76 have attachment points 78 for attachment thereto of links 79. Links 79 allow pull rods or tension bars 80,82 to be connected to ballast 84 by attachment points 86 on ballast 84. Pull rods or tension bars 80, 82 have a Z- shaped configuration and can be straightened when tensioned. Pull rods or tension bars 80,82 can have a plurality of bends in them to suit requirements and are not limited to the shape shown in this embodiment. Ballast 84 can be any form of weight, for example, a block of concrete, or a plurality of logs located in a framework as shown in FIGS. 1 to 5. Ballast 84 is located in a trough 88 with the base of the trough 90 being inclined.

In the preferred embodiment barrier 46 includes horizontal ram plates 92 which at each end are slidingly located on barrier supports 48,50 through guide holes 94. A plurality of vertical spacers 96 are welded between—respective horizontal ram plates 92 to provide a strong anti-penetration gate.

The number and position of vertical spacers 96 can be varied to suit requirements. It is preferred that the spacing between horizontal ram plates 92 is closer at a position where vehicle impact would occur. Vertical slats are welded to horizontal ram plates 92.

In the embodiment shown in FIGS. 6*a* to 6*e* the ballast 84 has been replaced by a second slide plate 100 which is supported by 12,14.

The second slide plate 100 is similarly affixed to top flange 18 via rivets 60*a*, 64*a*, 66*a* through slot 56*a* and corresponding rivets (not shown) and slot (not shown) on I-beam 12. FIGS. 6*a* to 6*e* provide a sequential illustration of a vehicle 102 attempting to crash through vehicle barrier system 10. The operation of the barrier system 10 is also applicable to the embodiment shown in Figs. to 5.

Figure 6A:
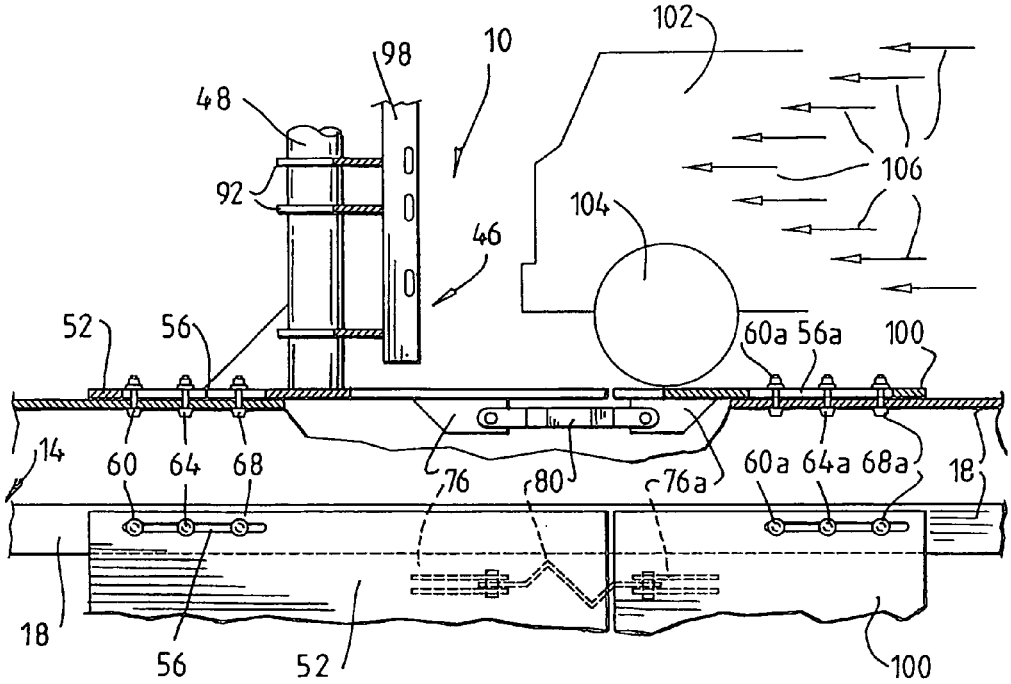
FIG. 6*a* is similar view to that of FIG. 5 which includes a part plan view made in accordance with a second embodiment of the invention showing a vehicle moving towards the barrier.
Figure 6B:
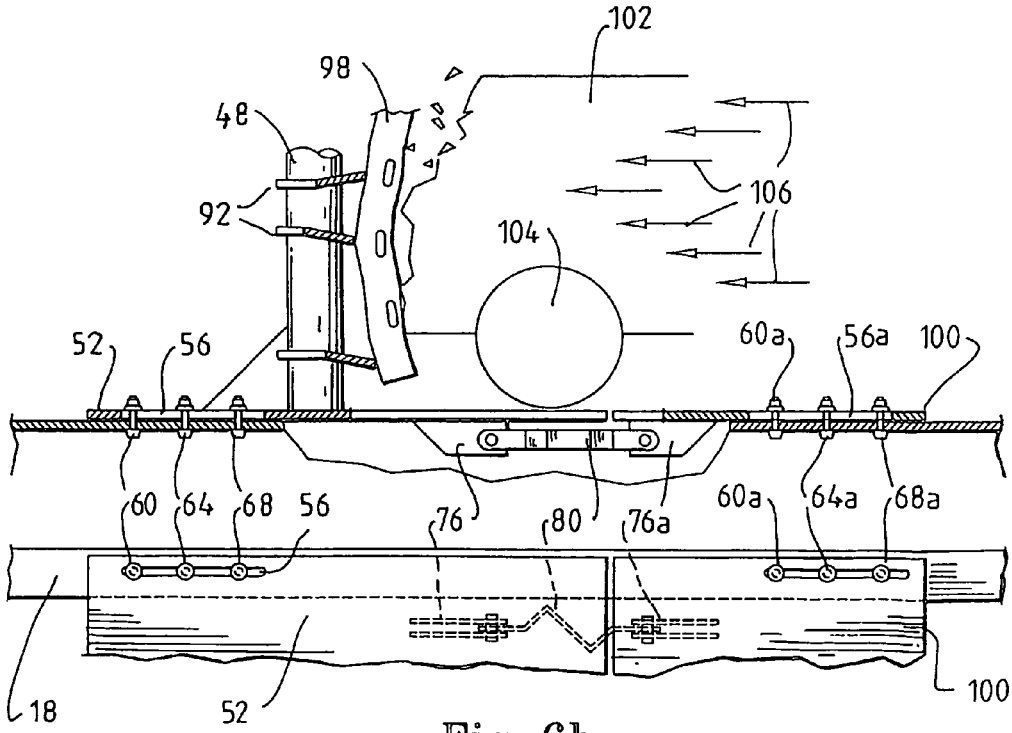
FIG. 6*b* is a similar view to that of FIG. 6*a* showing the vehicle impacting the barrier.

In FIG. 6*a*, vehicle 102 is moving with a velocity as indicated by arrows 106 and front wheels 104 will roll over second slide plate 100. Barrier 46 will be in the closed position as shown in FIG. 1. Vehicle 102 will continue to move forward and front wheels 104 will roll over slide plate 52 as shown in phantom lines 108 in FIG. 5 to make contact with barrier 46. FIG. 6*b* shows vehicle 102 having contacted barrier 46 with consequent damage to the vehicle and to vertical slats 98. The slats 98 will crumple and absorb an amount of impact force. The horizontal ram plates 92 and vertical spacers 96 will also assist in reducing the velocity of vehicle 102.

Slide plate 52 will be held fast at this time by rivets 58-68, which will be assisted by the weight of vehicle 102 upon slide plate 52 to increase the frictional forces needed to move slide plate 52.

Figure 6C:
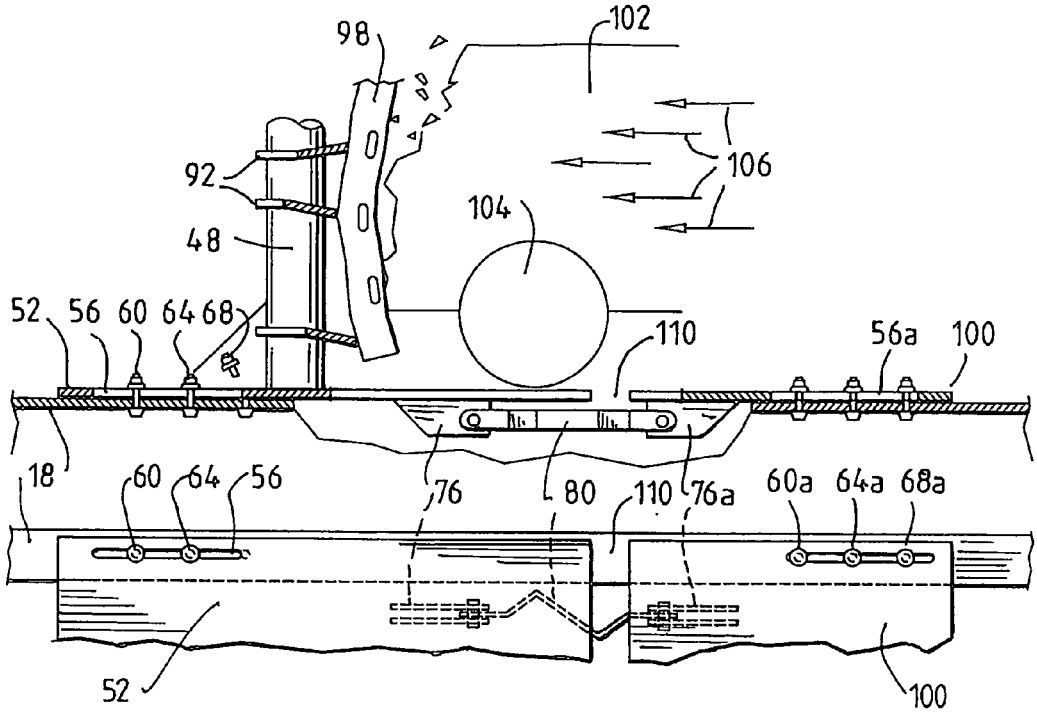
FIG. 6*c* is a similar view to that of FIG. 6*b* showing the shearing of the first set of rivets.

FIG. 6*c* shows that rivets 66,68 have been sheared at a predetermined force applied thereto. The force is applied to slide plate 52 through the impact load applied to barrier supports 48,50 passed from horizontal ram plates 92. Slide plate 52 will thus move to the left as indicated by the increasing width of gap 110 between slide plate 52, the straightening of pull rods 80,82 and the bowing of barrier supports 48,50 as shown by phantom lines 112 in FIG. 5. Slide plate 52 will slide along I-beams 12,14 to move barrier supports 48,50 with it and pivot and move about pins However, hollow beams 24,26 will not move as they are fastened to 24,26. The second slide plate 100 will provide resistance to assist in the straightening of pull rods 80,82.

Figure 6D:
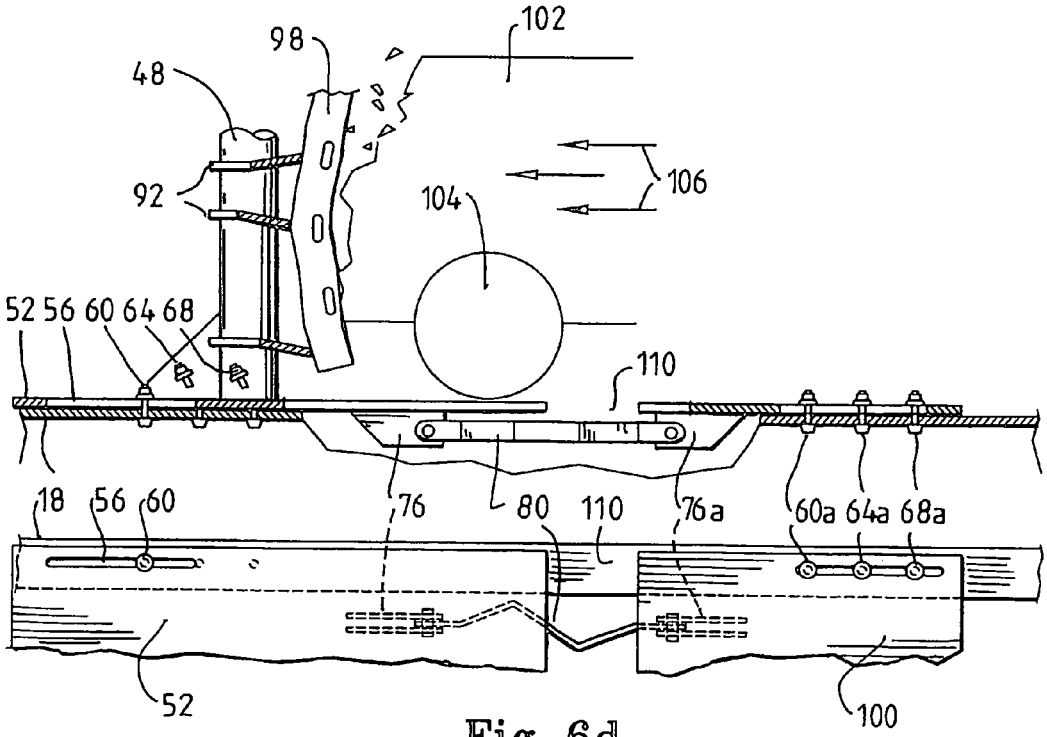
FIG. 6*d* is a similar view to that of FIG. 6*c* showing the shearing of the second set of rivets.
Figure 6E:
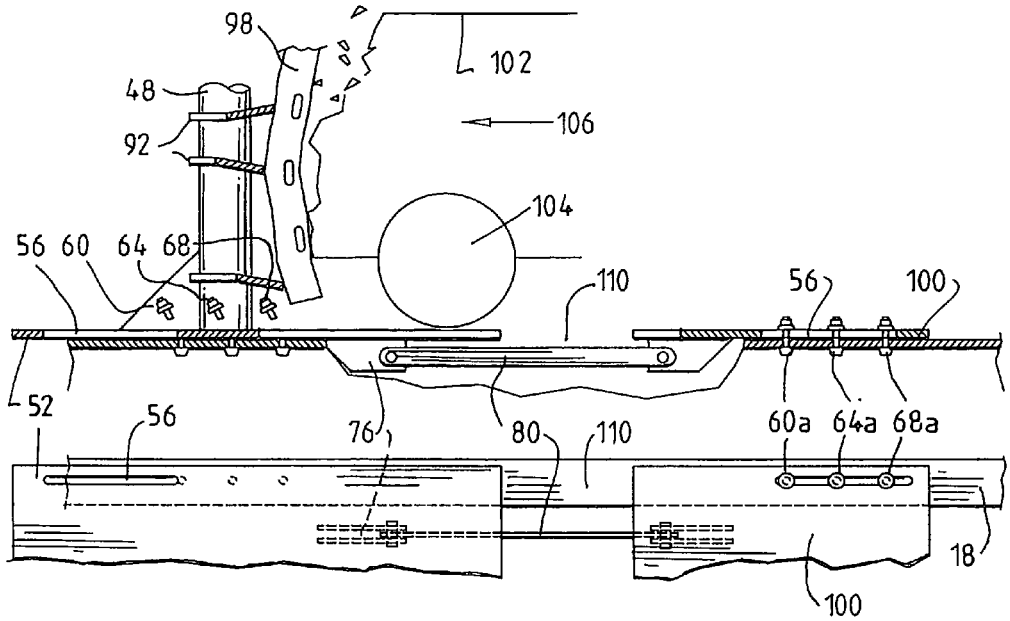
FIG. 6*e* is a similar view to that of FIG. 6*d* showing the shearing of the third set of rivets.

Further dissipation of the vehicle impact will occur when rivets 62,64 are sheared at a further predetermined force applied thereto as shown in FIG. 6*d*. Gap 110 will widen further and pull rods 80,82 will be further straightened. FIG. 6*e* shows rivets 60 being sheared to further increase the width of gap 110. Pull rods 80,82 have been fully straightened. The weight and speed of vehicle 102 will determine whether all rivets 58-68 will be sheared or whether the impact force is dissipated prior to that occurrence. If vehicle 102 is still not stationary, then the same sequence of shearing of rivets 60*a*, 64*a*, 68*a*, etc will occur for second slide plate 100. This sequence will not be described, as it will be obvious to the man skilled in the art based on the previous operational discussion.

In the embodiment shown in FIGS. 1 to 5 the second slide plate 100 is replaced by ballast 84. The operational sequences will be very similar with the resistance of the ballast 84 engaging when rivets 66,68 are sheared. In tests the vehicle barrier system 10 has been effective to prevent a 4000-kg (8800lb.) load from entering barrier 46 at 30 The damaged barrier 46 can be readily replaced as hollow beams 24,26 are not damaged and the barrier lifting mechanism is on the hollow beams 24,26. It is a relatively simple procedure to replace barrier 46 as barrier supports 48,50 can be re-used. The downtime for an attempted intrusion is substantially reduced without compromising safety.

Figure 7:
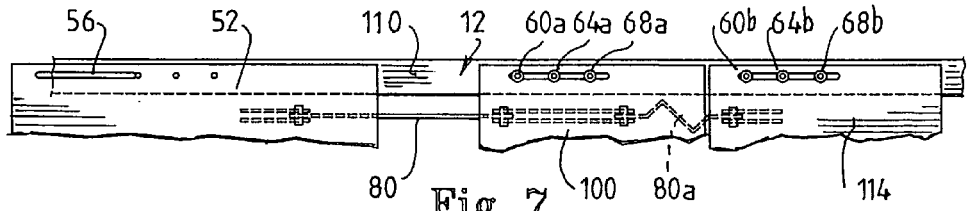
FIG. 7 is a plan view similar to that of the FIG. 6*e* of a third embodiment made in accordance with the invention.

FIG. 7 shows a very similar embodiment to that shown in FIGS. 6*a* to 6*e* with the addition of a third slide plate 114. Again third slide plate 114 is coupled to second slide plate 100 by pull rods 80*a* and is fastened to I-beams 12,14 by rivets 60*b*, 64*b*, 68*b*.

Figure 8:
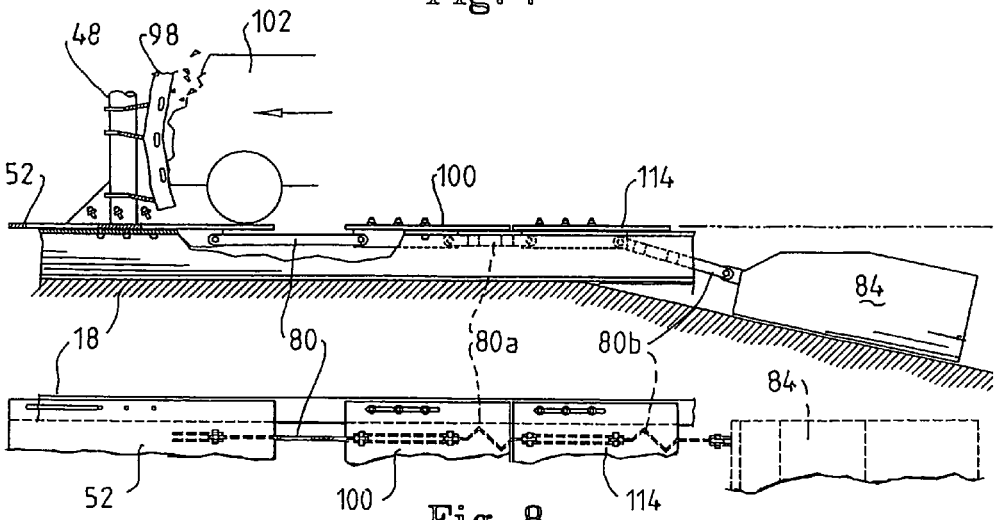
FIG. 8 is a similar view to that of FIG. 6*e* of a fourth embodiment made in accordance with the invention.

FIG. 8 shows a very similar embodiment to that shown in FIG. 7 with the addition of ballast 84 from the embodiment of FIGS. 1 to 5. Ballast 84 is coupled to third slide plate by pull rods 80*b*.

Figure 9A:
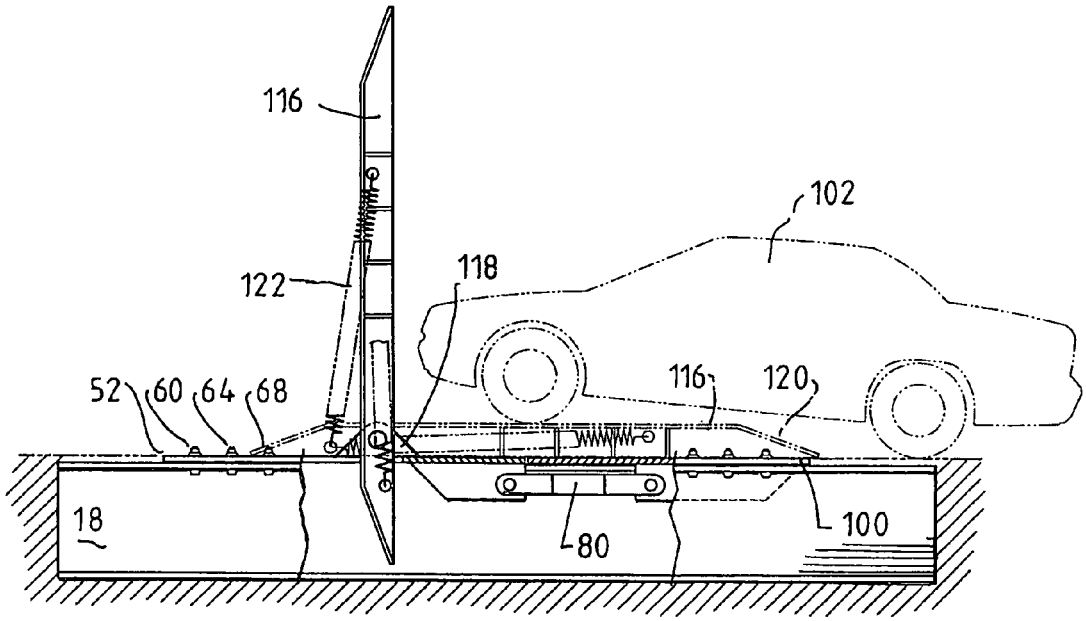
FIG. 9*a* is a similar view to that of FIG. 6*a* of a fifth embodiment made in accordance with the invention with the barrier closed.
Figure 9B:
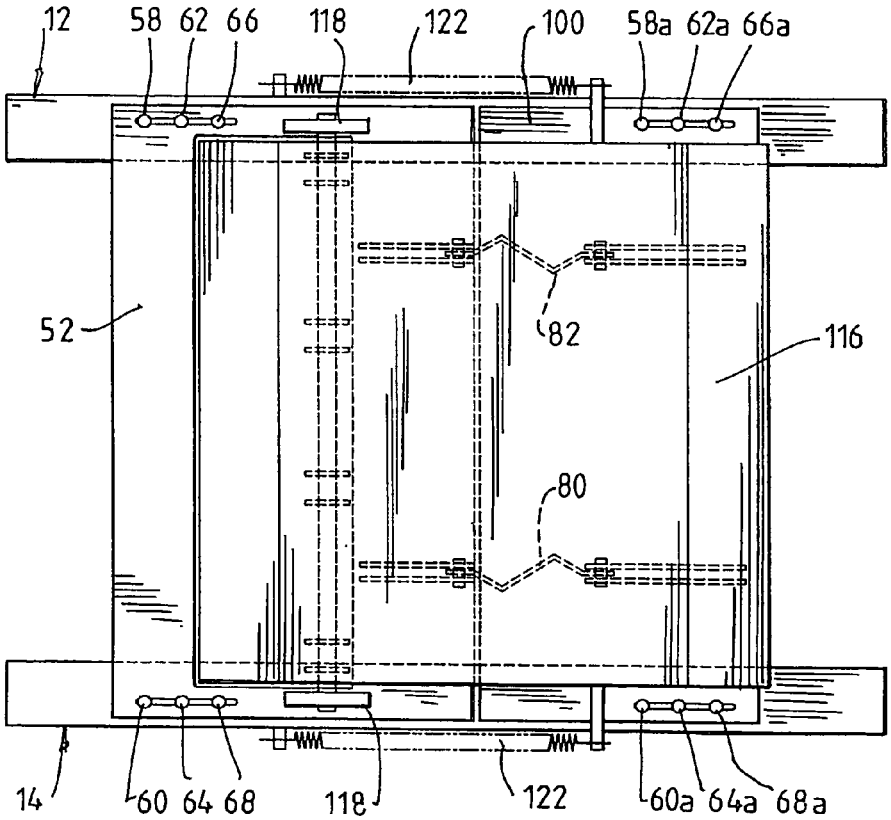
FIG. 9*b* is a plan view of the vehicle barrier system shown in FIG. 9*a* with the barrier open.

FIGS. 9*a* and 9*b* illustrate a further embodiment where barrier 46 is replaced by a pivotal ramp 116 which is attached to slide plate 52 through pivot plates 118.

Ramp 116 can pivot between a closed or vertical position as shown in FIG. 9*a* and a horizontal or open position as shown by phantom lines 120. The ramp 116 is held in either position by a latching mechanism (s) (not shown) and is biased towards the closed position by springs 122. There are slide plates 52,100, which are constructed and operate in a similar way to those shown in FIGS. 6*a* to 6*e*.

Vehicle 102 can drive over ramp 116 when in the open position as indicated in FIG. 9*a* but cannot pass when ramp 116 is raised. Ramp 116 can be of any suitable construction to withstand the initial impact by vehicle 102. This embodiment does not have the hollow beams 24,26. The impact force will be applied to slide plate 52 through the impact load applied to pivot plates 118 rather than barrier supports 48,50 passed from ramp 116. The movement of slide plates 52,100 will be the same as that described in FIGS. 6*a* to 6*e*.

Figure 10:
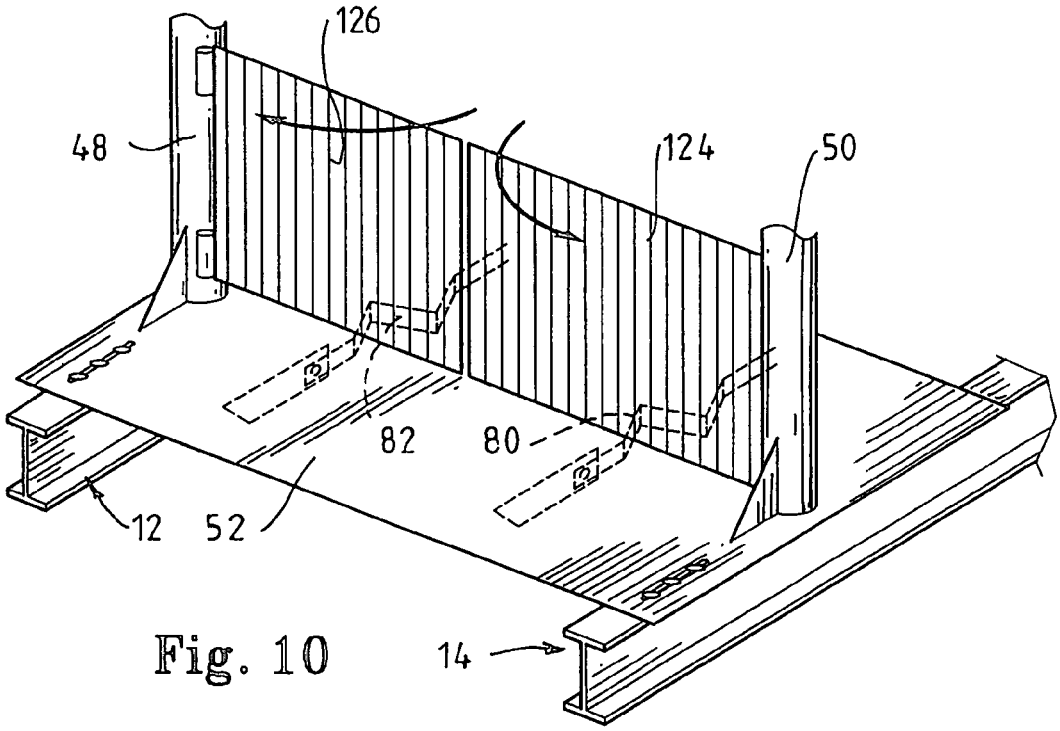
FIG. 10 is a perspective view of a sixth embodiment made in accordance with the invention.

The embodiment shown in FIG. 10 shows barrier 46 being replaced by a pair of swinging gates 124,126. Slide plate 52 will again operate in a similar manner to that previously described in relation to FIGS. 9*a* and 9*b*.

Figure 11:
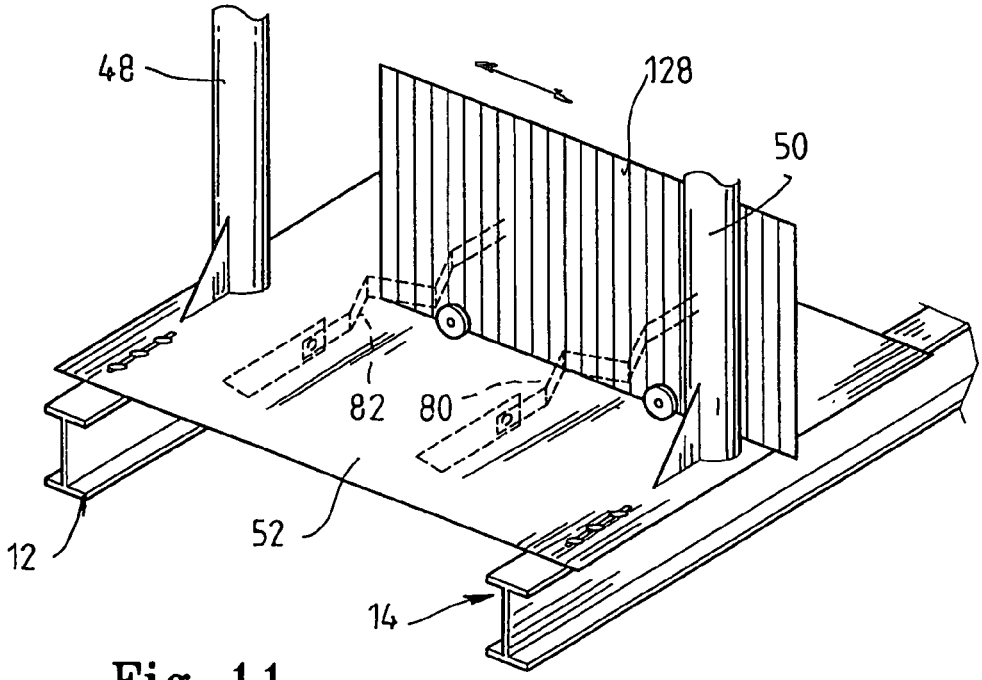
FIG. 11 is a perspective view of a seventh embodiment made in accordance with the invention.
Figure 12:
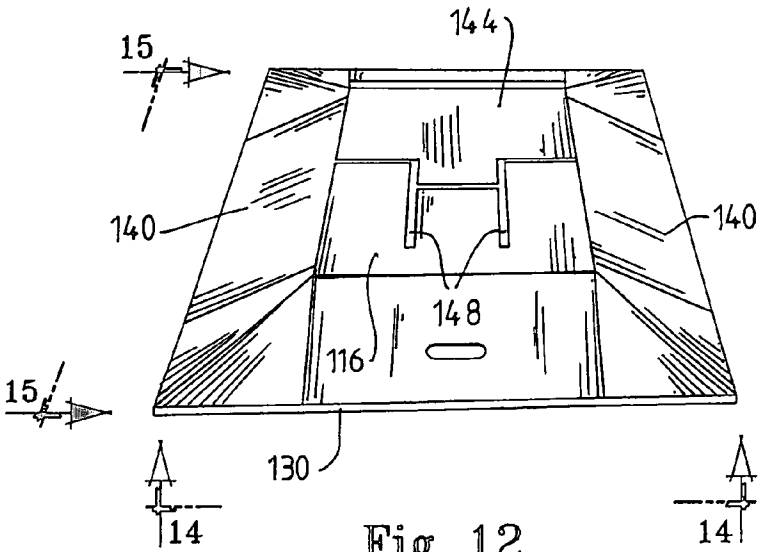
FIG. 12 is a perspective view of an eighth embodiment made in accordance with the invention showing the barrier lowered.
Figure 14:
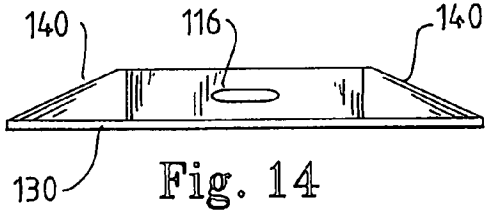
FIG. 14 is an end view in the direction of arrows 14-14 shown in FIG. 12.
Figure 15:
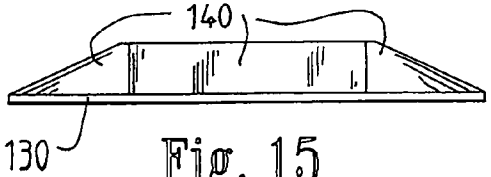
FIG. 15 is a side view in the direction of arrows 15-15 shown in FIG. 12.

The embodiment shown in FIG. 11 is similar to the embodiment shown in FIG. 10 with swinging gates 124,126 replaced by a sliding gate 128. Slide plate 52 will again operate in a similar manner to that previously described in relation to FIGS. 9*a* and 9*b*.

The embodiment shown in FIGS. 12 to 17*b* is similar to the embodiment shown in FIGS. 9*a* and 9*b*. In this embodiment the I-beams are replaced by an anchor plate 130 which is affixed to the ground. A plurality of holes 132 are formed in the ground and are preferably strengthened using concrete. Locking cylinders 134 are pushed through respective apertures 136 in slide plate 52 and locked in place by pins 138. The locking cylinders 134 are tamperproof as they are located underneath covers 140 and the end of ramp 116. A pair of tension bars 82 are secured at respective ends to slide plate 52 and anchor plate 130.

Ramp 116 is pivotally mounted to slide plate 52 through bracing elements 142.

Figure 13:
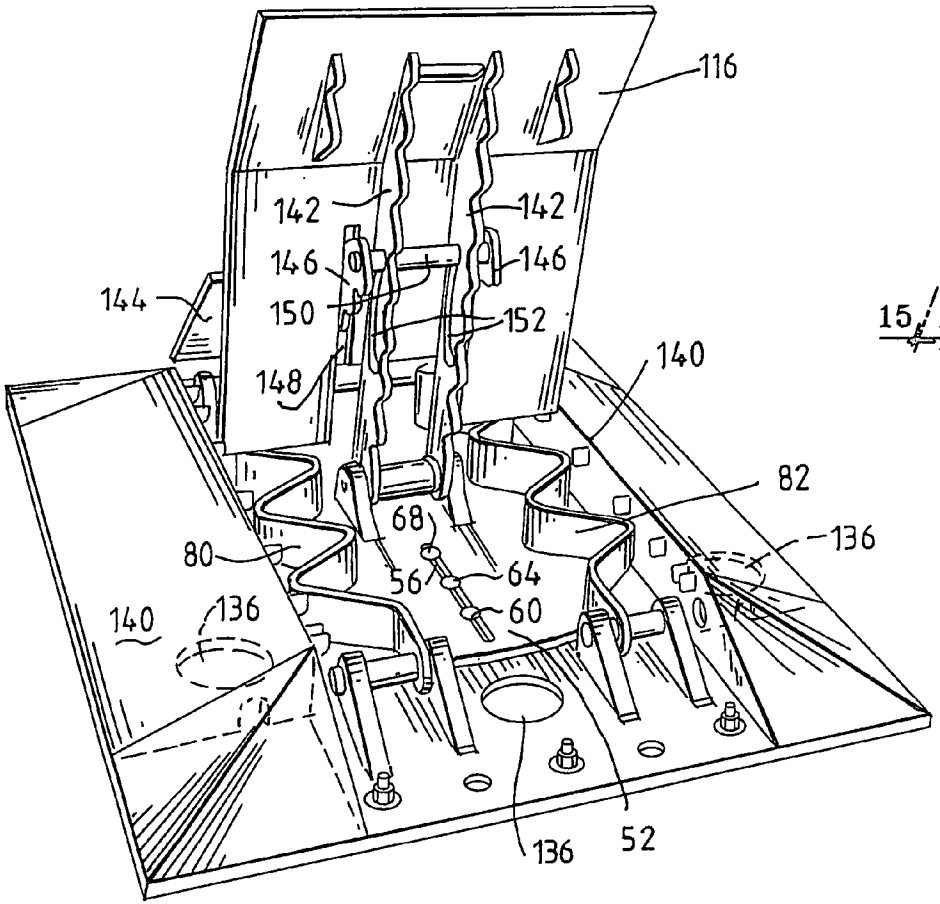
FIG. 13 is a perspective view of the embodiment shown in FIG. 12 with the barrier raised.
Figure 16:
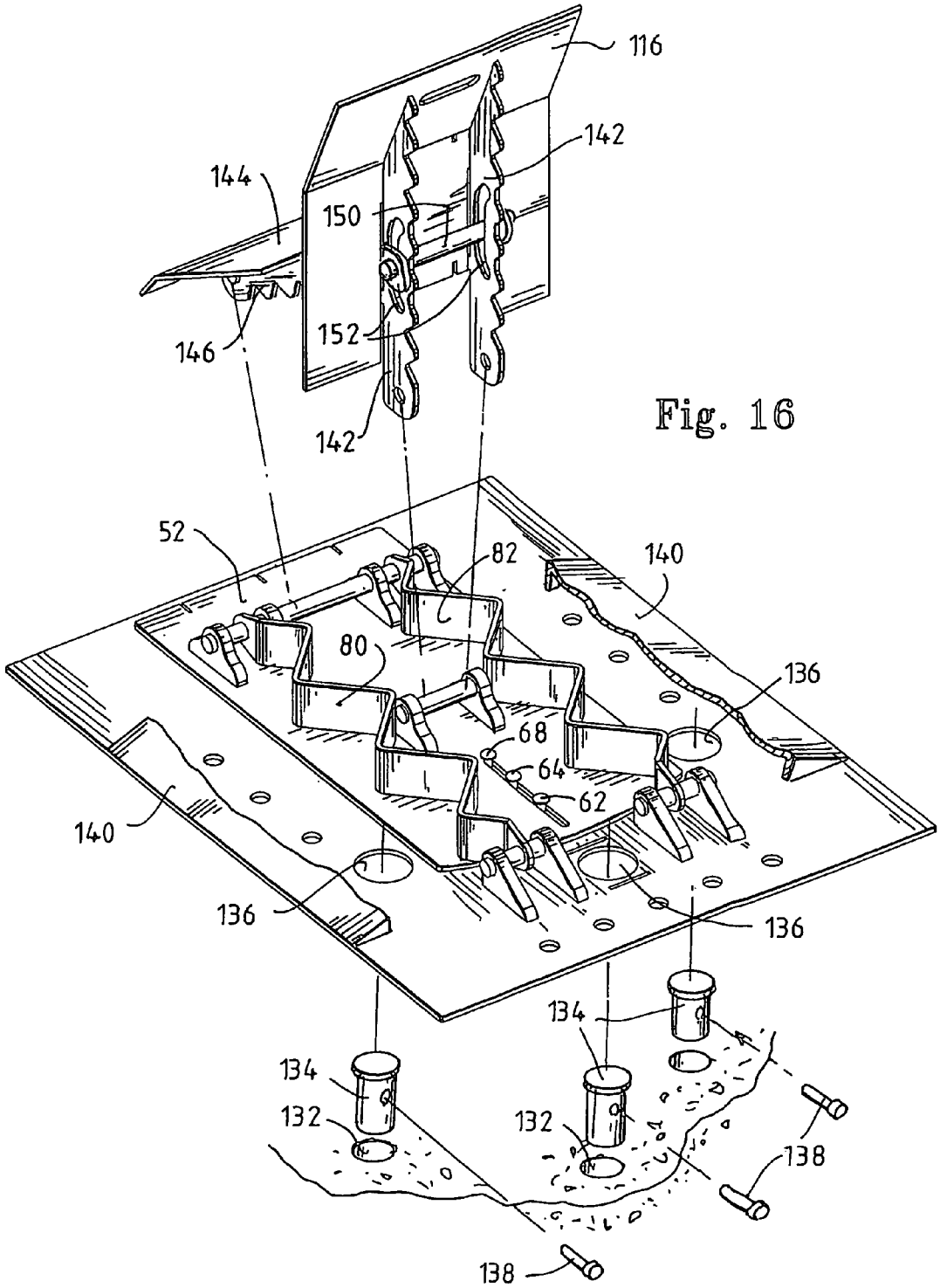
FIG. 16 is an exploded partial cross-sectional perspective view of the vehicle barrier system shown in FIG. 13.
Figures 17A, 17B:
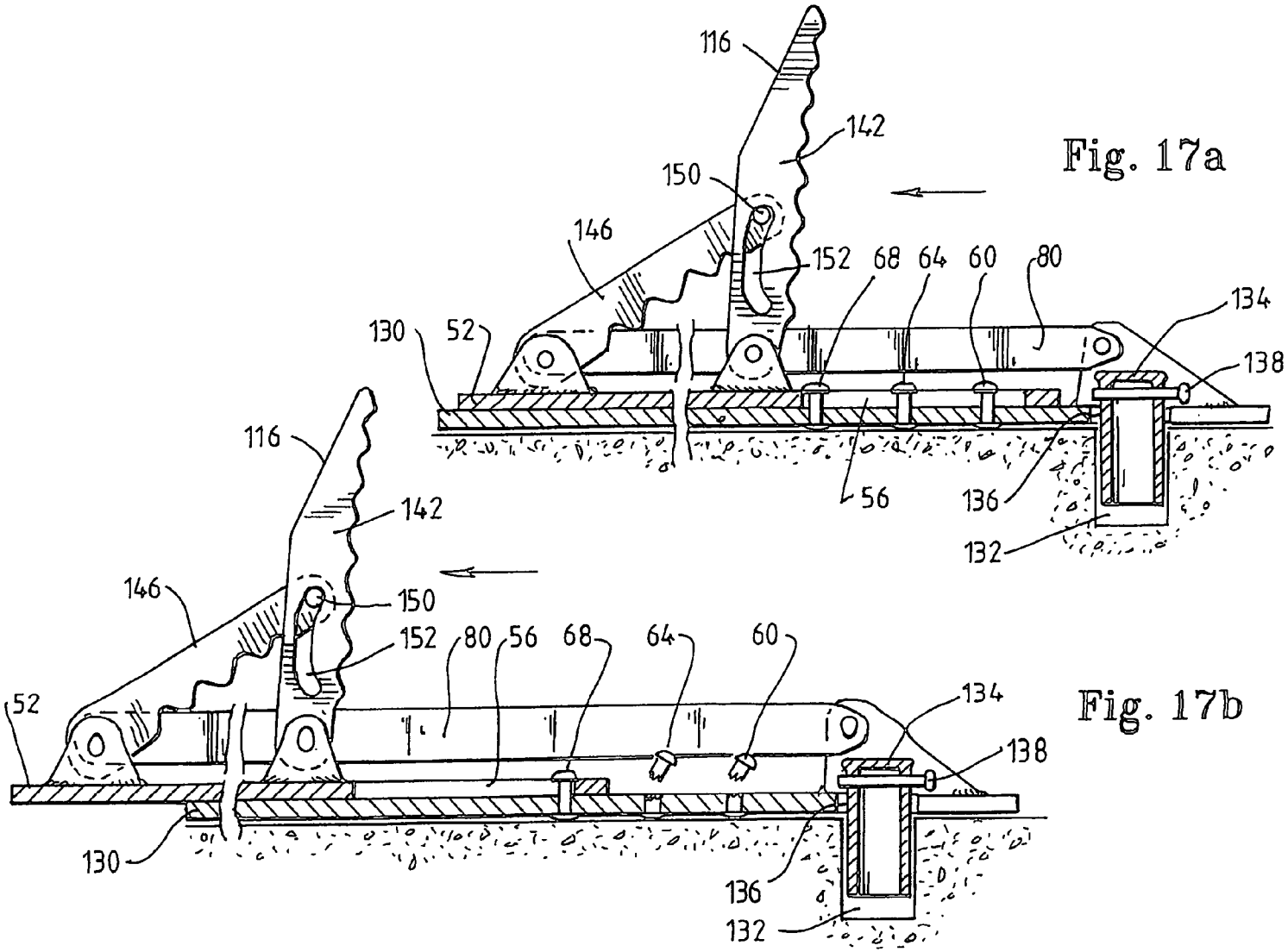
FIG. 17*a* is a longitudinal cross-sectional view of the vehicle barrier system shown in FIG. 13 before vehicular impact.
FIG. 17*b* is a longitudinal cross-sectional view of the vehicle barrier system shown in FIG. 13 during vehicular impact.
Figure 18A:
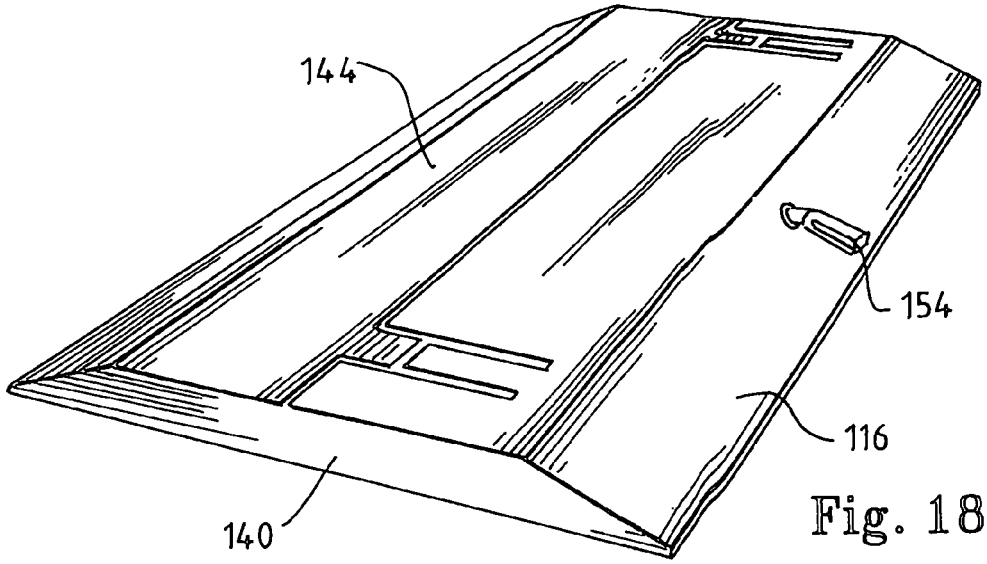
FIG. 18*a* is a perspective view of a ninth embodiment made in accordance with the invention showing the barrier lowered.
Figure 18B:
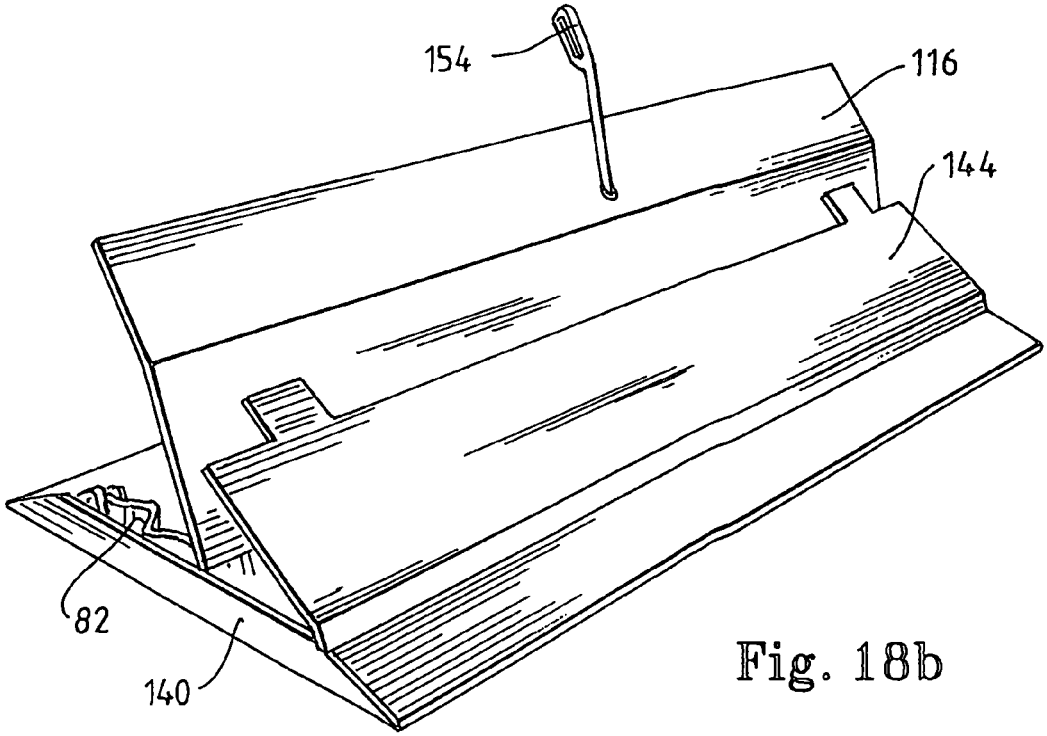
FIG. 18*b* is a perspective rear view of the embodiment shown in FIG. 18*a* with the barrier raised.
Figure 19:
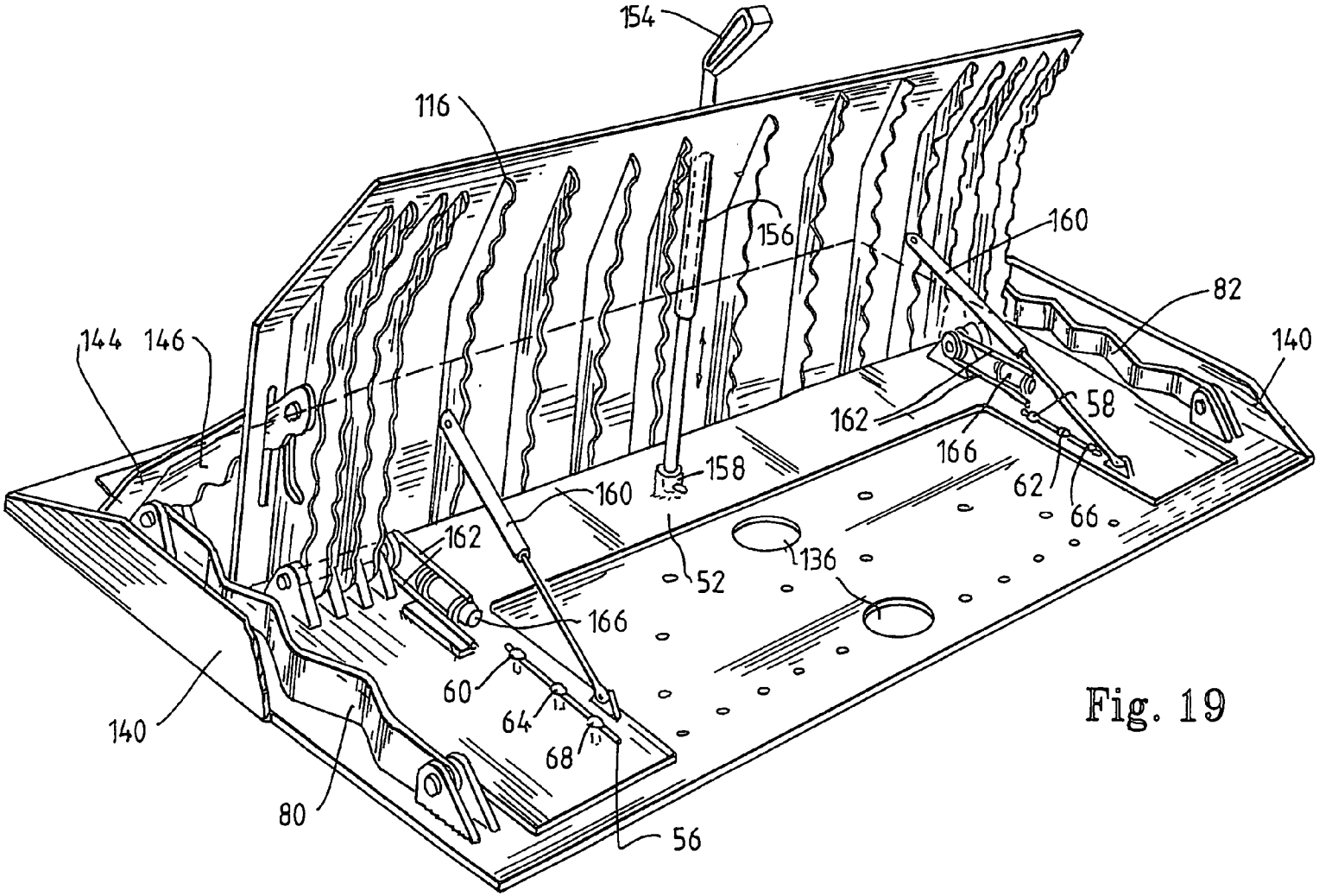
FIG. 19 is a perspective front view of the embodiment shown in FIG. 18*b* with the barrier raised.
Figure 20:
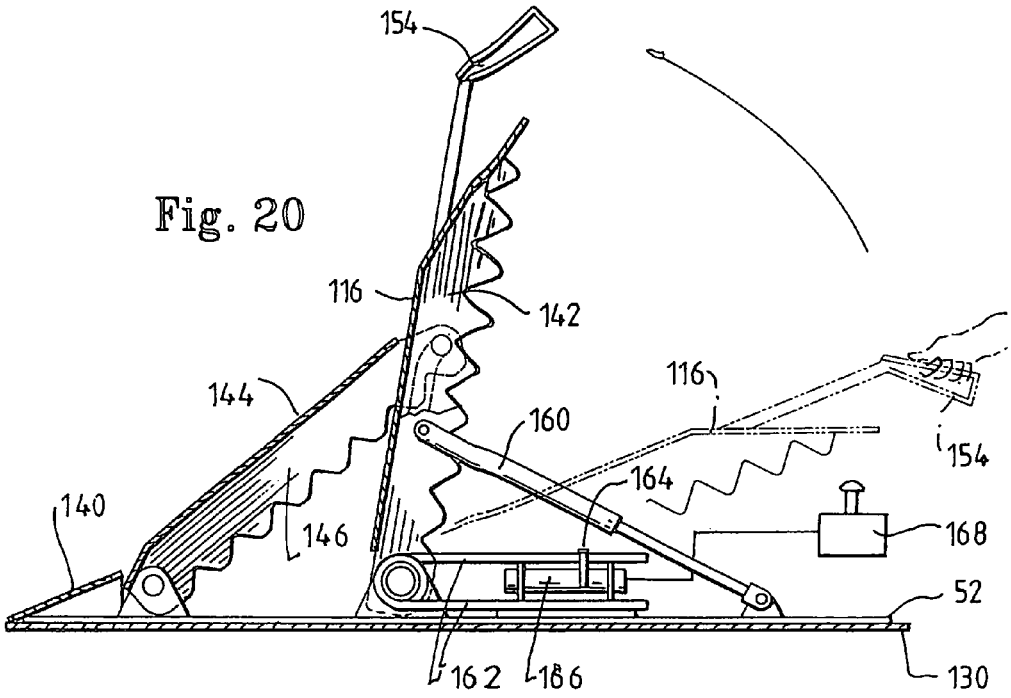
FIG. 20 is a longitudinal cross-sectional view of the vehicle barrier system shown in FIG. 19 with the barrier being manually raised.
Figure 21:
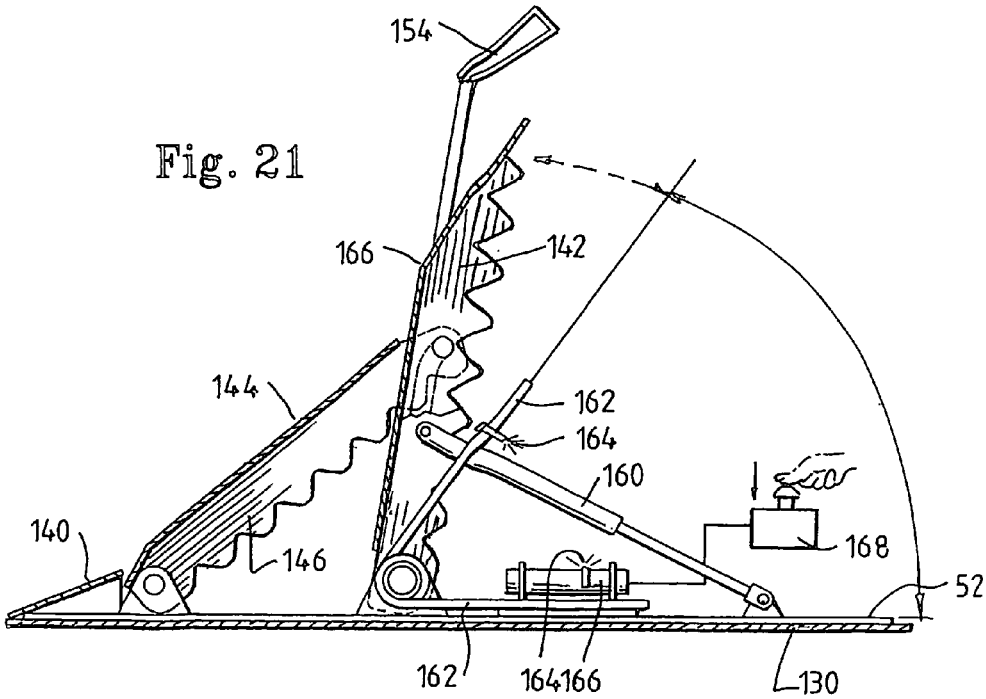
FIG. 21 is a longitudinal cross-sectional view of the vehicle barrier system shown in FIG. 19 with the barrier being automatically raised.

Bracing elements 142 are notched to grip the vehicle at impact and provide deformation of the vehicle to reduce the speed of the vehicle. A back plate 144 is also pivotally mounted to slide plate 52 and provides additional support to ramp 116 under impact. Again bracing elements 146 are provided to strengthen the back plate 144. Bracing elements 146 protrude slots 148 in ramp 116 and are coupled to pin 150 which is guided within track 152 on bracing elements 142. When non-operational, the vehicle barrier system in FIGS. 12 to 17*b* is folded into the position shown in FIG. 12. A vehicle may be easily driven over the vehicle barrier system and it will act basically as a speed hump. The operational position is shown in FIGS. 13 and 17*a* with ramp 116 in the raised position. Any unauthorised vehicle will travel in the direction of the arrow shown in FIG. 17*a* and ride over covers 140 and hit ram ramp 116. The impacting of the vehicle is shown in FIG. 17*b* and is similar in operation to that of FIGS. 9*a* and 9*b* with slide plate 52 moving along anchor plate 130 and severing in turn the rivets 60,64, 66 and straightening of tension bars 80,82. The embodiment shown in FIGS. 18*a* to 21 is very similar to the embodiment shown in FIGS. 12 to 17*b*. In this embodiment a handle 154 is locatable in a tube 156 and has one end located in boss 158 on slide plate 52. The handle 154 will allow a manual movement of ramp 116 into its raised position as shown in FIG. 20. By locating the handle in tube 156, additional strength will be provided to the ramp 116 on impact. Gas struts 160 will also assist in the raising of ramp 116. An example of a remote activated raising of ramp 116 is also shown in this embodiment. A pair of springs 162 are held in a tensioned condition as shown in FIGS. 19 and 20. The springs 162 are held by pin 164 coupled to an explosive device 166. When explosive device is detonated electronically by switch 168, pin 164 will be released and the tensioned force contained within springs 162 will immediately raise ramp 116 as shown in FIG. 21. The explosive device 166 can be substituted by any other suitable activation means, for example, solenoid, etc. The impact operation of this embodiment will be the same as the embodiment of FIGS. 12 to 17*b*.

Figure 22:
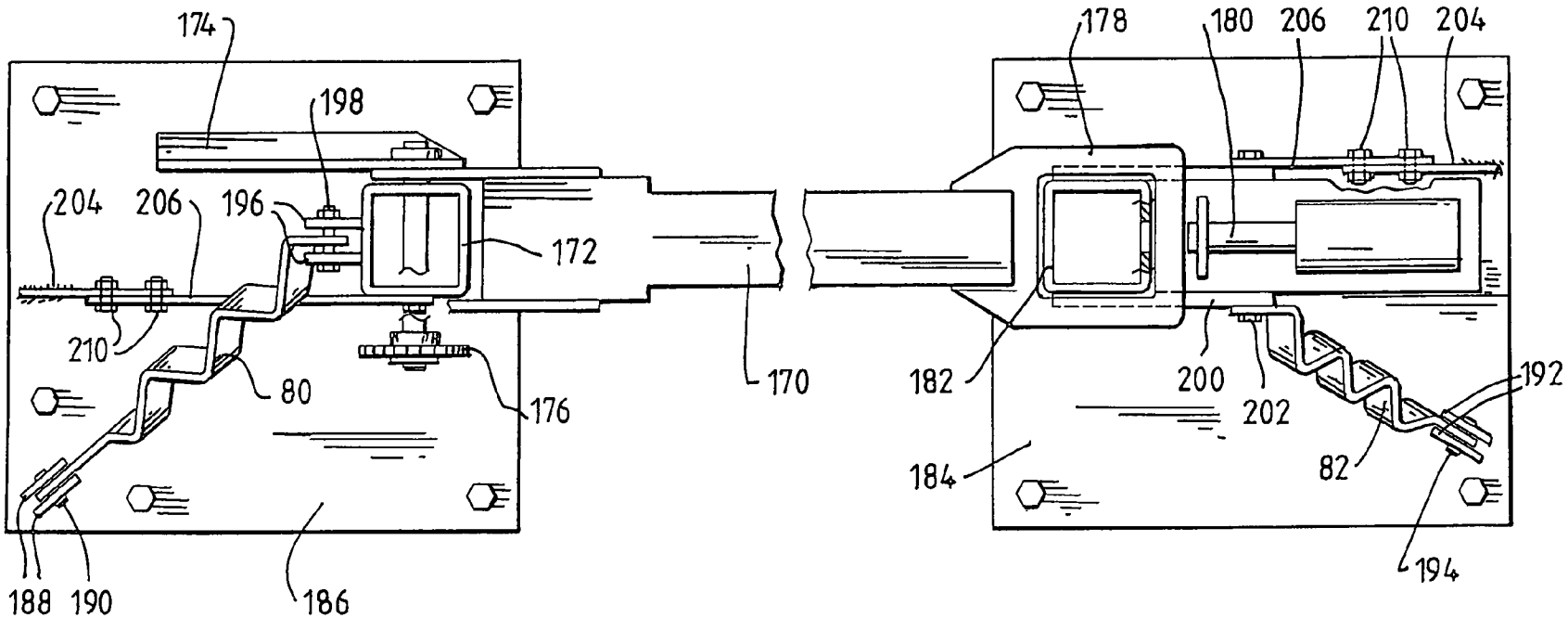
FIG. 22 is a plan view of a tenth embodiment made in accordance with the invention showing the barrier closed.
Figure 23:
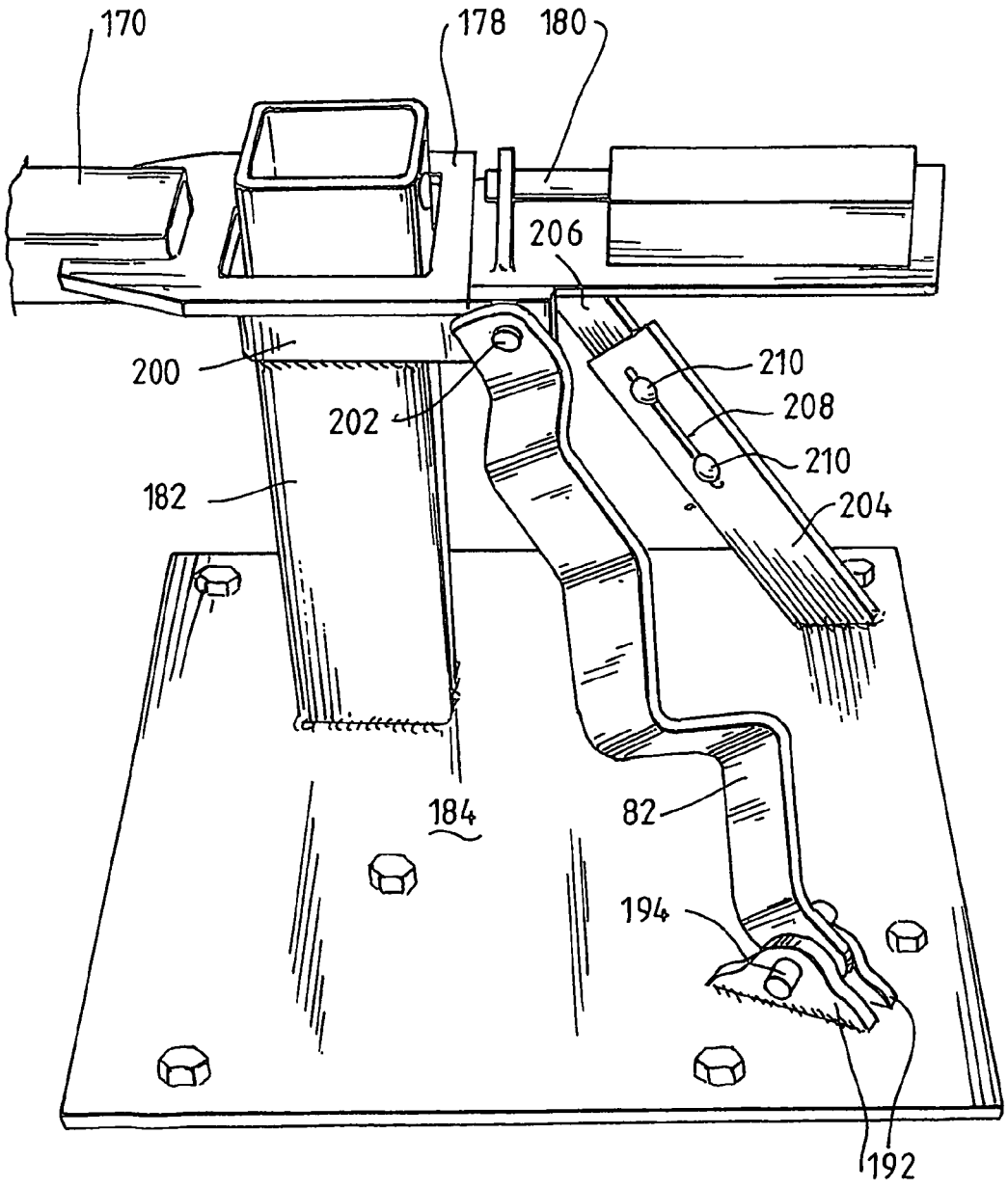
FIG. 23 is a perspective view of one end of the vehicle barrier systems shown in FIG. 22.
Figure 24:
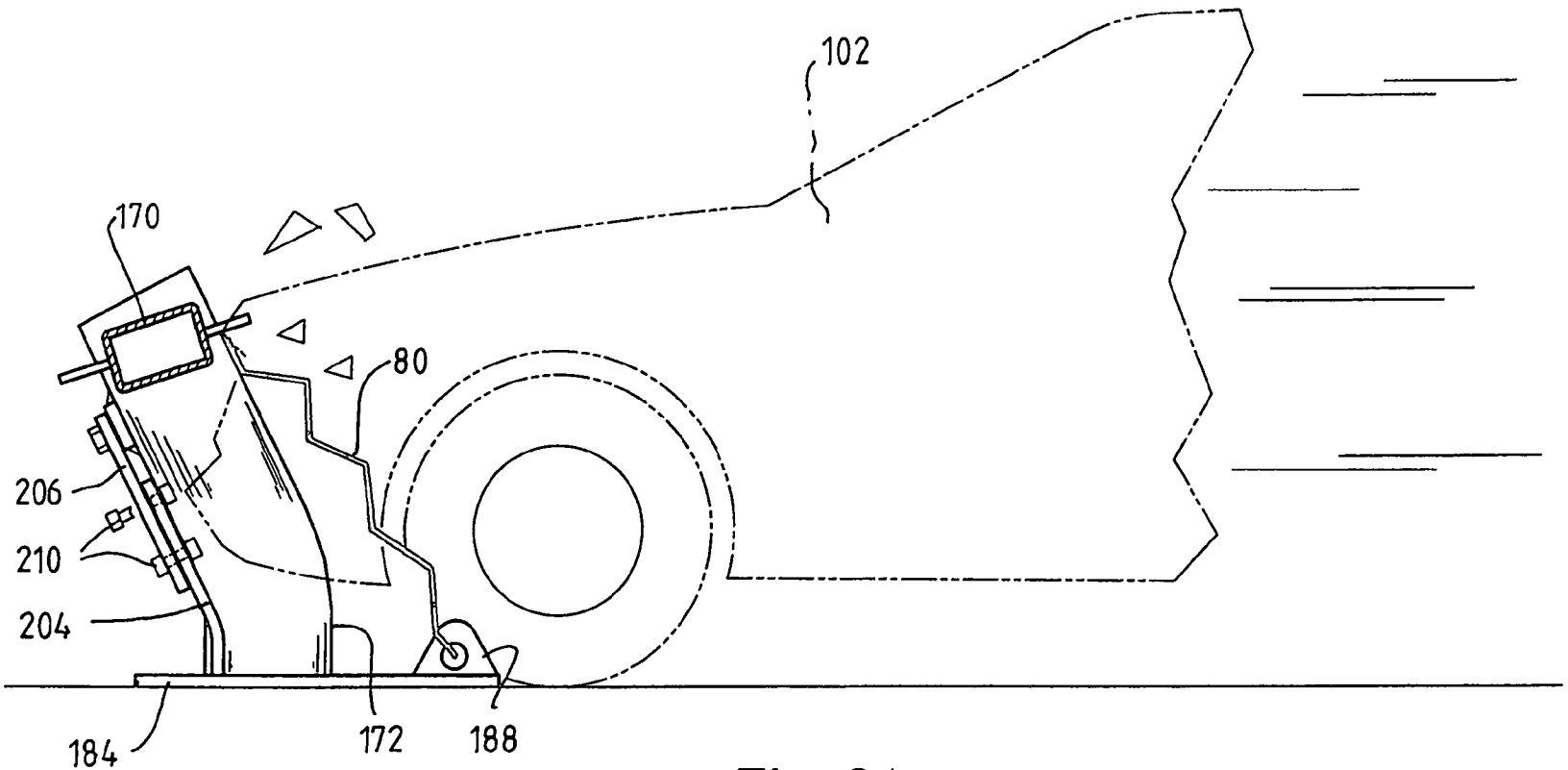
FIG. 24 is a cross-sectional view of the embodiment shown in FIG. 22 during vehicular impact.

The embodiment shown in FIGS. 22 to 24 differs from the previous embodiments by the different positions of the slide plate and tension bars. This embodiment shows a boom gate 170 which is pivotally mounted to support 172.

Boom gate 170 can be raised manually by handle 174 or electrically through a gear 176 coupled to a gear driven motor means (not shown). A latch 178 is attached at the other end of boom gate 170 and can be locked in position by solenoid 180. A further support 182 is provided and both supports 172,182 are attached to ground anchor plates 184,186 which are secured to the ground.

Tension bar 80 is secured to ground anchor plate 184 by brackets 188 and pin 190 whilst tension bar 82 is similarly secured by brackets 192 and pin 194. The other ends of tension bars 80,82 are again secured to supports 172,182 by brackets 196,200 and pins 198, 202. The method of attachment can be varied to suit requirements, for example, direct welding or other means. A pair of fixed plates 204 are also welded to anchor plates 184,186 at an angle thereto. Slide plates 206 are attached to both supports 172,182. Respective slots 208 in fixed plates 204 allow slide plates 206 to be held thereagainst by rivets FIG. 24 shows the operation of the vehicle barrier system of FIGS. 22 to 24.

When the vehicle 102 impacts with boom gate 170 the supports 172, 182 will be bent backwards which will cause extension of tension bars 80,82. Further bending of supports 172,182 will cause the sequential shearing of rivets 210 in a similar manner to the previously described embodiments.

From the above description of the various embodiments it is evident to the man skilled in the art may make changes to the construction of the vehicle barrier system 10. Depending on construction constraints slide plate 52 need not be coupled to a further slide plate or ballast. The construction of barrier 46 can be of any suitable type that can withstand a heavy impact. The number and types of slide plates can vary. Similarly, the numbers of rivets can be varied from 1 to any number deemed applicable. The shearing strength of the rivets can be varied or be the same. The preferred embodiments have been described with reference to their use as a gate but the construction is also applicable to doors of buildings.

The invention will be understood to embrace many further modifications as will be readily apparent to persons skilled in the art and which will be deemed to reside within the broad scope and ambit of the invention, there having been set forth herein only the broad nature of the invention and certain specific embodiments by way of example.

The invention claimed is:

1. A vehicle barrier system including a barrier movable between an open position to allow vehicle access therethrough and a closed position which prevents vehicle access therethrough, said barrier being attached to barrier supports at either end of said barrier, said barrier supports being secured to a slide plate which will slide after a predetermined force is applied thereto by vehicle impact with said barrier to absorb the impact energy of said vehicle;

wherein movement of the slide plate is controllable by the shearing of at least two rivets securing said slide plate to at least one fixed surface on which it slides, said rivets protruding from said fixed surface through a pair of slots on opposing sides of said slide plate;

wherein said at least one fixed surface is formed by a pair of ground engaging beams aligned with respective slots in said slide plate; and wherein a pair of upright beams is secured to the ground in front of respective barrier supports, said upright beams being secured to said pair of ground engaging beams at one end and pivotally and/or slidably linked to said barrier supports at the other end.

2. The vehicle barrier system as claimed in claim 1 wherein said slide plate is sufficiently long to have a part of said vehicle sitting thereon at impact.

3. The vehicle barrier system of claim 1, wherein said barrier allows structural deformation to occur to absorb impact forces.

4. The vehicle barrier system of claim 1, wherein said barrier can be raised into said open position and lowered into said closed position.

5. The vehicle barrier system of claim 1, wherein said barrier can be pivotally lowered into said open position and pivotally raised into said closed position.

6. The vehicle barrier system of claim 1, wherein said barrier can be slid open into said open position and slide closed into said closed position.

7. The vehicle barrier system of claim 1, wherein said barrier includes a first and second barrier pivotally attached at their opposing ends, said barriers can be pivotally swung from their opposing ends into said open position and pivotally swung closed into said closed position.

8. A vehicle barrier system including a barrier movable between an open position to allow vehicle access therethrough and a closed position which prevents vehicle access therethrough, said barrier being attached to barrier supports at either end of said barrier, said barrier supports being secured to a slide plate which will slide after a predetermined force is applied thereto by vehicle impact with said barrier to absorb the impact energy of said vehicle;

wherein movement of the slide plate is controllable by the shearing of at least one rivet securing said slide plate to at least one fixed surface on which it slides, said at least one rivet protruding through at least one slot in said slide plate from said fixed surface;

wherein said at least one fixed surface is an anchor plate which is secured to the around by affixing means;

wherein said barrier forms part of a ramp in its open position and is pivotally attached at either side to said slide plate to be raised from said slide plate to a substantial vertical position to its closed position; and wherein a further support is coupled at the rear of said barrier to further assist in preventing collapse of said barrier from vehicular impact when said barrier is in its substantial vertical position.

9. The vehicle barrier system of claim 8, wherein a pair of tension bars is connected between said anchor plate and said slide plate whereby, in use, said pair of tension bars will lengthen when said barrier is struck by said vehicle.

10. A vehicle barrier system including a barrier movable between an open position to allow vehicle access therethrough and a closed position which prevents vehicle access therethrough, said barrier being attached to barrier supports at either end of said barrier, said barrier supports being secured to the ground on at least one ground engaging plate, a pair of bridging slide plates on one side of each of said barrier supports attached at one end to a respective said barrier support and at the other end to said at least one ground engaging plate, said slide plates joined by at least one rivet, said slide plates movable with respect to one another when said at least one rivet is sheared after a predetermined force is applied from vehicular impact with said barrier to absorb the impact energy of said vehicle.

11. The vehicle barrier system as claimed in claim 10, further including a tension member on the other side of said barrier support linking its respective ground engaging plate to said barrier support.

12. The vehicle barrier system as claimed in claim 10, wherein movement of the slide plates is controllable by the shearing of a plurality of rivets, said plurality of rivets protruding through at least one slot in one of said slide plates.

* * * * *